United States Patent [19]

Folkmar

[11] Patent Number: 4,783,042

[45] Date of Patent: Nov. 8, 1988

[54] FLEXIBLE MOULD FOR FREEZING SMALL BODIES OF ICE AND AN ICE-MOULDING SET WITH SUCH A MOULD

[75] Inventor: Jan Folkmar, Zurich, Switzerland

[73] Assignee: Ice-Pack Service AG, Otelfinge, Switzerland

[21] Appl. No.: 52,081

[22] PCT Filed: Jul. 29, 1986

[86] PCT No.: PCT/EP86/00448

§ 371 Date: Apr. 3, 1987

§ 102(e) Date: Apr. 3, 1987

[87] PCT Pub. No.: WO87/01183

PCT Pub. Date: Feb. 26, 1987

[30] Foreign Application Priority Data

Aug. 12, 1985 [DK] Denmark ..... 3655/85
Aug. 20, 1985 [DK] Denmark ..... 3781/85

[51] Int. Cl.[4] ..... A23G 9/00
[52] U.S. Cl. ..... 249/127
[58] Field of Search ..... 249/119, 127, 117, 128, 249/132, 129, 130; 383/107; 156/344; 426/122

[56] References Cited

U.S. PATENT DOCUMENTS

| | | | |
|---|---|---|---|
| 3,023,000 | 4/1962 | Clements et al. | 206/47 |
| 3,086,264 | 4/1963 | Tindall | 24/30.5 |
| 3,204,760 | 9/1965 | Whileford | 383/107 |
| 3,478,052 | 11/1969 | Perlman | 383/107 |
| 3,571,861 | 3/1971 | Olson | 24/30.5 |
| 4,478,386 | 10/1984 | Mikkelsen | 249/119 |

FOREIGN PATENT DOCUMENTS

| | | |
|---|---|---|
| 1286849 | 1/1967 | France . |
| 2378243 | 8/1978 | France . |
| 2381259 | 9/1978 | France . |
| WO82/0079 | 2/1982 | PCT Int'l Appl. . |

*Primary Examiner*—Bernard Nozick
*Attorney, Agent, or Firm*—Nolte, Nolte and Hunter

[57] ABSTRACT

In a disposable bag (10) for freezing ice lumps (15), the bonding areas (17) dividing the bag into compartments (16) are relatively weak, at least at temperatures below freezing point. With this arrangement, the ice lumps (15) can be freed by stretching and/or "massaging" the bag (10), so that the dividing bonding areas (17) are disrupted and the bag changed into one without compartments. The ice lumps (15) may then be removed singly or en masse from the bag (10).

8 Claims, 4 Drawing Sheets

FLEXIBLE MOULD FOR FREEZING SMALL BODIES OF ICE AND AN ICE-MOULDING SET WITH SUCH A MOULD

The present invention relates to a flexible mould and especially to a disposable mould bag for receiving and retaining therein liquid or the like to be frozen into a plurality of ice pieces by using such a mould bag as well as to closure means for such moulds.

Such moulds or bags are fairly widely used for example for freezing water into "ice-cubes"—not necessarily cube-shaped for use in cooling beverages, as well as for freezing fruit juice or dessert-ice mixtures into so-called "ice lollies". They do, however, suffer from certain disadvantages, that may account for the fact that many people prefer not to use them. Among these disadvantages the following may be mentioned:

- the process of freezing the ice bodies from the flexible moulds is time-consuming and not always easy,
- it is difficult to avoid touching at least some of the ice bodies, unless special precautions are taken, such as wearing of protective gloves,
- pieces of the plastic sheet material constituting the mould may be torn off and adhere to the ice bodies, not to be discovered before the beverage or ice lolly in question is consumed,
- some of the ice bodies may "shoot out" from the mould and fall on the floor or disappear behind a piece of furniture.

According to one embodiment of the invention, the bag constituting the flexible mould may be changed from a compartmented bag suitable for moulding the ice bodies into an uncompartmented bag by suitably manipulating the bag after the completion of the freezing process. The un-compartmented bag will then contain all the ice bodies formed lying loose in the bag, and thus easy to remove, singly or en masse, facilitating the opening of the bag in various ways described below.

Another embodiment of the invention is especially useful for making ice lollies, as the mould may be divided into section, each containing one ice lolly or stick of ice, which sections may be opened gradually when the lollies are being consumed.

According to another embodiment of the invention the strength of the dividing bonding areas will be relatively high when filling the mould with unfrozen liquid, while it will be low, making it easy to disrupt the dividing bonding areas, when the liquid has been frozen to bodies of ice. The force required to disrupt wide bonding areas may be reduced by using a preferred embodiment.

The mould may be manufactured in indefinite lengths and may be cut into lengths suitable for use.

The present invention also relates to a moulding set for freezing small bodies of ice.

Figure 3:
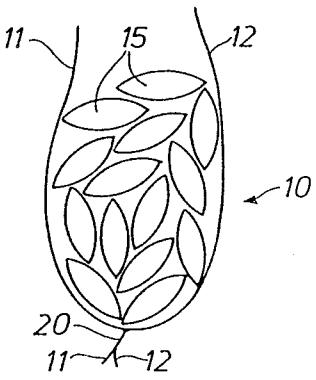
Figure 2:
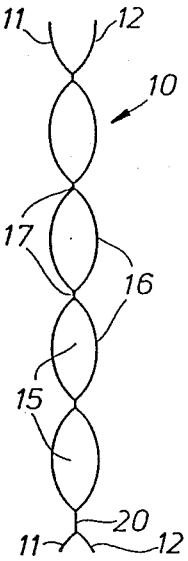
Figure 1:
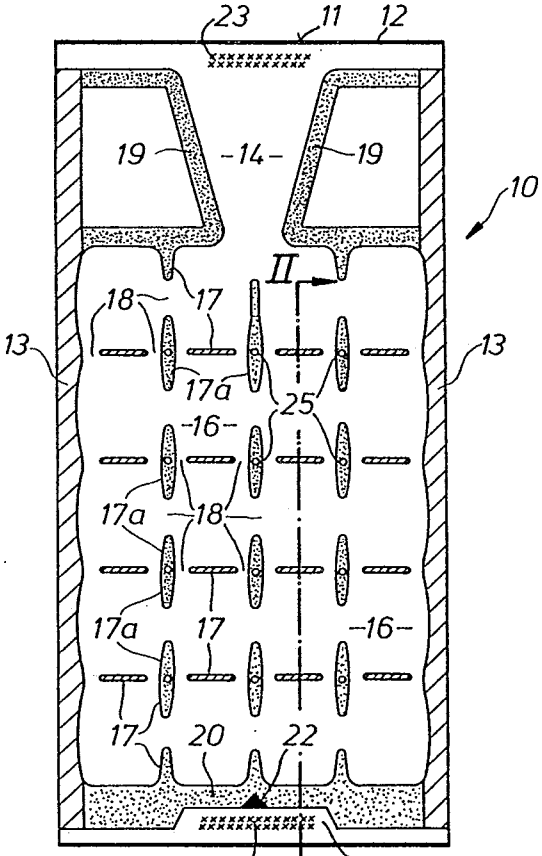
Figure 4:
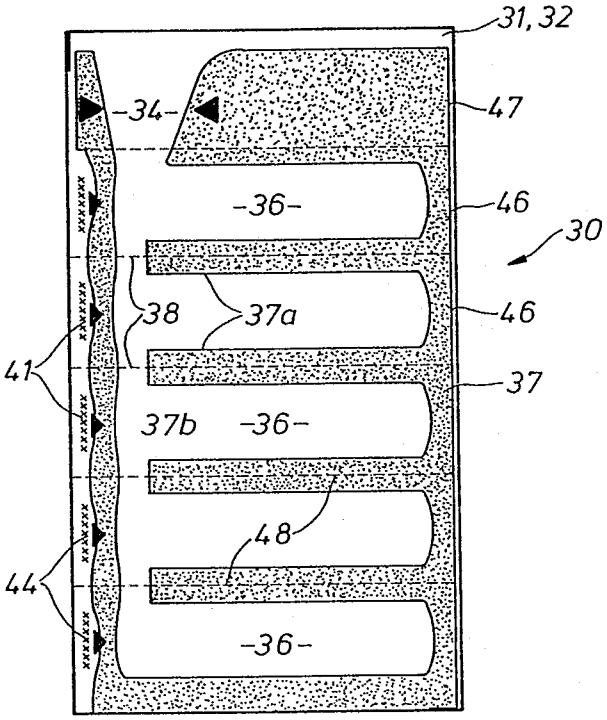
Figure 6:
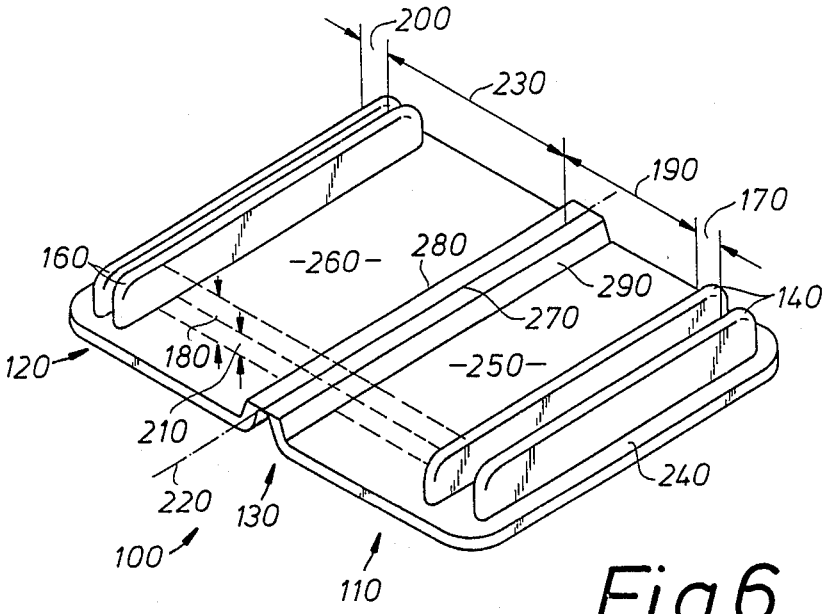
Figure 7:
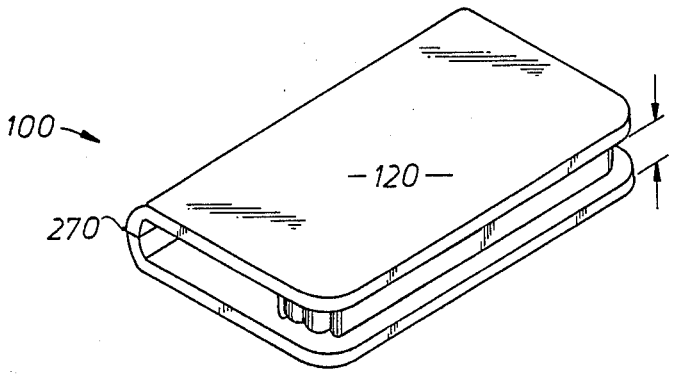
Figure 8:
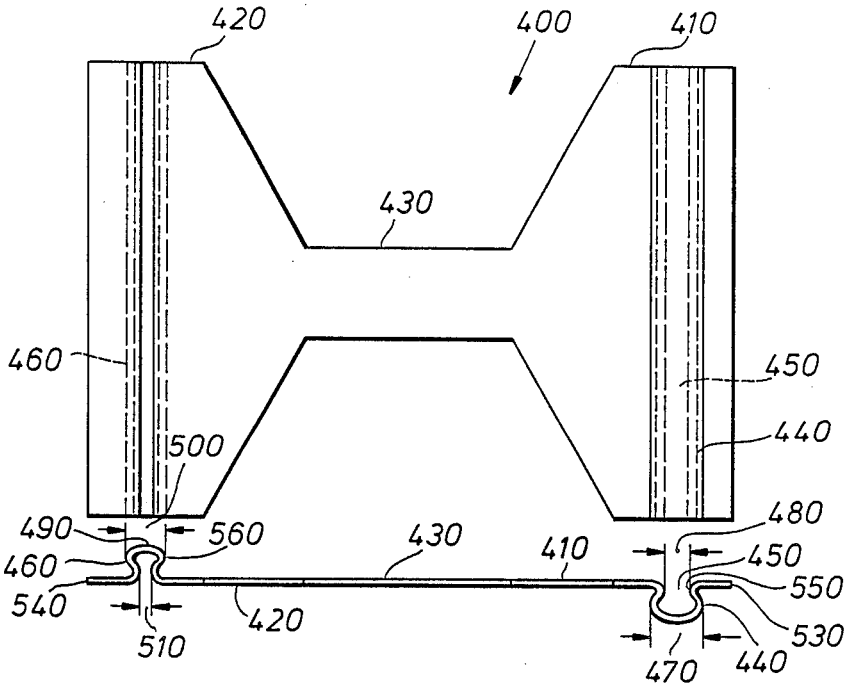

The invention will now be explained in more detail with reference to exemplary embodiments of a flexible mould according to the present invention shown in the drawings, in which FIG. 1 is a diagrammatic view of a so-called freezing bag for "ice cubes", as viewed against one of its flat sides in the unfilled condition, FIG. 2 is a section along the line II—II in FIG. 1 and showing the compartments of the bag filled with liquid or frozen lumps, FIG. 3 is a sectional view corresponding to FIG. 2, but showing the bag after disruption of the dividing bonding areas with a number of ice lumps lying loose in the bag, FIG. 4 is a view according to FIG. 1 on a freezing bag for ice rods or "lollies", FIG. 5 in two views at right angles to each other shows a section of the freezing bag shown in FIG. 4, containing an ice lolly and opened to give access to the ice lolly, FIG. 6 in perspective shows a first embodiment of a closure for a mould bag in the open state, FIG. 7 shows a perspective view of the closure of FIG. 6 in its closed state, FIG. 8 shows another embodiment of a closure, viewed at right angles to and parallel to the main plane of the closure in the un-stressed condition, respectively, and FIG. 9 in a somewhat larger scale shows the closure of FIG. 8 in a position, in which it keeps a bag closed.

The flexible mould shown in FIGS. 1 to 3 in the form of a bag 10 of thin sheets 11 and 12 of plastics material, such as polyethylene, is closed on three sides and partly closed on the fourth side. On the fourth side mentioned, shown uppermost in FIG. 1, there is a filling duct 14 for filling the bag 10 with liquid, such as water, to be frozen in the form of pillow-shaped ice lumps 15 shown in FIGS. 2 and 3. The right-hand and left-hand edges of the bag 10 are permanently sealed, such as in first bonding areas 13, that may be welded.

The space between the first bonding areas 13 is subdivided into a number of compartments 16 by means of a number of second bonding areas 17 shown dot-shaded in FIG. 1. Passages 18 between the individual second bonding areas 17, 17*a*, and between some of them and the first bonding areas 13 allow the liquid to flow into, and any air to escape from all of the compartments 16, where the bag is being filled with liquid, so that the sheets 11 and 12 will bulge out at each compartment 16 as shown in FIG. 2.

On each side of the filling duct 14 the two sheets 11 and 12 are bonded to each, other in third bonding areas 19 of the shape shown in FIG. 1 and contiguous with the first bonding areas 13 at the edges of the bag, and with some (in this case two) of the second bonding areas 17, 17*a*, on the side facing the compartments 16.

At the opposite end, shown lowermost in FIG. 1, the bag is closed by a fourth bonding area 10 being contiguous with some (in this case three) of the second bonding areas 17, 17*a* on the sides facing the compartments 16. The third and fourth bonding areas 19 and 20 respectively are preferably produced in the same manner and have the same characteristics as the second bonding areas 17, 17*a* to be described below.

The special feature characteristic of the present invention lies in the nature of the second bonding areas 17, 17*a*. In these areas, the two sheets 11 and 12 forming the bag 10 are bonded to each other in such a manner that the two sheets may be pulled apart using only a limited force without the two sheets being torn around the second bonding areas 17, 17*a* such as would be the case with previously known bags of this kind. This may be achieved by producing the second bonding areas 17, 17*a* by using some suitable welding method, which a person skilled in the art of welding plastics sheet material would be able to devise without further guidance, one possible avenue being multiple spot or line welding with welding spots or lines of microscopic size. Another preferred possibility would be to use an adhesive having an exquisite property of limited adhesive strength, preferably diminishing with falling or decreasing temperature, so that the bonds would be fairly strong when filling the bag 10 with water at a temperature of, say 10° C., but considerably weaker or even brittle at temperatures below the freezing point of water.

The effect of using such second bonding areas 17, 17*a* of limited strength will now be explained. After filling the bag 10 with water, so that its compartments 16 take on the shape shown in FIG. 2, the bag is placed in a cold space. After a sufficient length of time, the water will have been frozen to ice lumps 15, one in each compartment 16. The bonds in the second bonding areas 17, 17*a*, are now disrupted, such as by first stretching the bag 10 and then "massaging" it, after which the bag will take on the shape shown in FIG. 3, i.e. as a simple un-compartmented bag with a number of ice lumps 15 lying loose in the lower part of the bag. The ice lumps 15 may now be removed from the bag 10 by opening the latter at the top and/or bottom and emptying its contents into a suitable container. The bag 10 may—at the same time or later—be opened at the top by disrupting the third bonding areas 10 on both sides of the filling duct 14, or at the bottom by disrupting the fourth bonding area 20. To facilitate the latter operation, the fourth bonding area 20 is formed with an external recess 21, preferably as shown continuing in a tear-starting slit 22. Since said bottom bonding area 20 is provided with an external recess 21 its disruption is facilitated. The external recess 21 preferably is continuing in at least one tear-starting slit 22 within said bottom bonding area 20.

The mould preferably is divided into a number of sections 46, 47, each of which comprises one of a number of mould compartments 36 and at least one filling duct 34. Sections 46, 47 are joined to each other through tear lines 48 with a reduced strength allowing the mould to be disrupted along the tear lines 48 substantially without any disruption of said bonding area 37 occurring. Instructional texts may be printed on the bag as shown at 23 and 24 respectively.

In an embodiment not shown in the drawing, the flexible mould consists of a length of thin-walled tubing, constructed generally in the same manner as the bag 1 shown in FIG. 1, but open at both ends, possibly also somewhat narrower with only one or two rows of compartments instead of four as shown in FIG. 1. Such tubing may be produced in indefinite lengths using suitable machinery with means for producing both first bonding areas 13 of full strength on both edges and means for producing second bonding areas 17, 17*a* of reduced strength, the latter areas preferably being produced first to facilitate the use of a suitable adhesive as mentioned above. In use, such tubing is cut to the desired length, closed at one end by means of a suitable closure or clip, filled with liquid to be frozen, and then closed at the other end, before being placed in a cold space for freezing the liquid. The ice lumps produced are removed by removing at least one of the closures or clips, after which the requisite number of ice lumps are squeezed out of the tubing, the second bonding areas being disrupted in the process. It is preferred to use a closure of the kind described below in connection with FIGS. 6 to 9.

To facilitate the disrupting of the wider portions 17*a* of the second bonding areas, unbonded areas 25 are included within each such wider portion. Similar unbonded areas (not shown) may for the same purpose be included in the third and fourth bonding areas 19 and 20, respectively. The unbonded areas 25 preferably having circular shape, as shown in FIG. 1 are arranged approximately in the center of each portion 17*a*.

In the exemplary embodiment shown in FIGS. 1–3, the side edges of the bag 10 are closed by the first bonding areas 13. It is, of course, possible to make the bag 10 from a piece of tubular stock instead of the two sheets 11 and 12, in which case the first bonding areas 13 would be superfluous. The mould bag of FIG. 1 comprises below its funnel opening 14, a plurality of portions 17*a* being arranged in several vertical rows. Each portion 17*a* of each row is spaced from the adjacent portion 17*a* of the same row and is extended in vertical direction. Further the rows or columns are spaced apart from each other. Portions 17 being extended in horizontal direction are provided in horizontal rows and are spaced from each adjacent portion 17 of the same horizontal row. As it may be seen from FIG. 1, the (horizontal) rows of portions 17 are intersecting said (vertical) rows of portions 17*a* preferably such that for example portions 17 of the uppermost horizontal row are positioned on a level approximately corresponding to the middle of the uppermost portions 17*a*, and so on. As mentioned, portions 17*a* cover a greater area than portions 17. By this arrangement the individual compartments for each ice cube or the like are defined in a pattern which is clearly shown in FIG. 1.

Flexible moulds or bags as described above with reference to FIGS. 1 to 3 have been produced and successfully used using the following materials:

(a) for the sheets 11 and 12: high-density polyethylene with
a thickness in the range of 0.01 to 0.05 mm,
(b) for the adhesive used in the second bonding areas 17: two-component polyurethane glue.

FIG. 4 shows a freezing bag 30 for rod-shaped pieces of ice or sticks of ice, which when consisting of frozen fruit juice or the like are usually called "ice lollies". The freezing bag 30 consists of two thin sheets 31 and 32, preferably of the same material as used for the two sheets 11 and 12 in the bag 10 shown in FIGS. 1 to 3.

Figure 5:
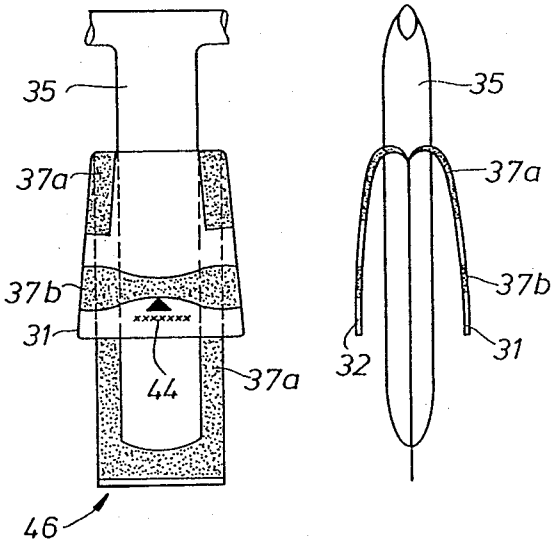

In roughly the same manner as the freezing bag 10 shown in FIGS. 1 to 3, the freezing bag 30 shown in FIG. 4 comprises a filling duct 34, through which the liquid to be frozen is introduced, so as to flow into a series of compartments 36, each adapted to mould one ice rod or ice lolly 35, vide FIG. 5, passages 38 interconnecting the various compartments 36.

The pattern of the filling duct 34, compartments 36 and passages 38 shown in FIG. 4 is formed by joining the two sheets 1 and 32 by means of a bonding area 37 of the same nature as the second bonding area 37 may be disrupted without causing disruption of the sheets 31 and 32 being joined thereby. The bonding area 37 comprises partitions 37*a* between the compartments 36 and an external wall 37*b* on the far side of the passages 38.

Each of the compartments 36 is a part of a mould section 46, each mould section 46 being joined to the adjacent mould section 46 or the upper or filling section 47 through areas in the sheets 31 and 32 weakened by tear lines 48, the latter being so weak compared to the strength of the bond in the partition portions 37*a* of the bonding area 37, that each mould section 46 may be torn away from the remaining mould sections or the filling sections 47 without the bond being disrupted. If the tear lines 48 are in the form of perforations, they should only be formed in areas outside of the filling duct 34 and the passages 38, as they would otherwise cause the liquid to leak out of these passages.

The end of each mould section 46 opposite the compartment 36 is closed by the external wall 37*b*. Outside of each compartment 36 the external wall 37*b* is formed with an external recess 41. Each external recess 41 is intended as a starting point for opening the respective mould section 46 in a manner to be described below, an instructional text 44 providing the requisite guidance to the user.

When the freezing bag 30 shown in FIG. 4 is to be used for making ice lollies, the bag is held generally vertically with the filling duct 34 uppermost, preferably slightly tilted with the left-hand upper corner a little higher than the right-hand one to enable air to leave the compartments 36. In this position and according to the preferred embodiment of FIG. 4 the bag comprises several compartments 36 each extending in transverse direction. The compartments are arranged one above the other while said passages 38 are provided between funnel 34 and the lowermost compartment 36 forming a vertical passage between a left-hand bonding area or margin 37*b* and bonding areas 37*a*, 37. Thus bonding areas 37*a* as well as tear lines 48 are arranged in transverse directions.

When the bag is filled by pouring liquid to be frozen—such as a suitable fruit juice, dessert-ice mixture or the like—down the filling duct 4, the liquid is gradually filling all the compartments 36 and the passages 38 interconnecting them.

After having been filled, the bag 30 is closed, such as by folding the filling section 47 along a line or a number of lines roughly parallel to the tear lines 48 and/or clamping the filling section in a suitable manner, e.g. using a closure mentioned below with reference to the exemplary embodiment shown in FIGS. 6 to 9. Then the bag is placed in a suitable cold space, such as the freezing compartment of a refrigerator or in a deep-freeze cabinet, so that the liquid is frozen to form a number of—in this case five—ice lollies 35.

When the user wishes to consume one of the ice lollies, he will remove the lowermost mould portion 46 from the remainder of the bag 30 with contents 35 by breaking the "neck" of the lolly connecting it to the next one and by disrupting the bag by tearing along the lowermost tear line 48. After thus having liberated the lolly from the remainder of the bag and its contents, the user will open the mould section in question by tearing the two sheets 31 and 32 apart, starting by gripping the sheets immediately outside of the external recess 41 and moving them away from each other, thus first disrupting the bonding area portion constituted by the respective part of the external wall 37*b*, and then the bonding area portions constituted by the partition portions 37*a*, folding the sheets 31 and 32 back along the remainder of the mould section 46 as shown in FIG. 5, not quite unlike the manner of peeling a banana and consuming same. This is possible because of the fact that sheets 31, 32 may be disconnected or pulled apart along their bonding areas 37, 48 without damaging the sheets themselves.

If a number of ice lollies 35 are to be consumed, the above operation is, of course, repeated with the remaining mould sections 46, the last section, i.e. the filling section 47, being discarded, if necessary after removing (and saving) the closure mentioned.

In the following preferred embodiments of a closure means for bags as mentioned in connection with FIGS. 1 to 5 are explained. After having folded the filling section 14 or 34, said closure means is used to fix or clamp the folded filling section and to hold it closed.

The closure 100 shown in FIGS. 6 and 7 consists of a female part 110 and a male part 120, hingedly interconnected by a hinged interconnecting member 130 in such a manner that by moving the two parts 110 and 120 together from the position shown in FIG. 6 to the position shown in FIG. 7, an insertion member 160 on the male part 120 is inserted into engagement with a channel member 140 on the female part 110. When using the closure 100 for its intended purpose, i.e. for closing a thin-walled bag or tube of plastic foil or the like according to FIG. 1 to 4, the end of the bag or tube is placed between the insertion member 160 and the channel member 140 before these two members are brought into final engagement, thus closing the end of the bag or tube in question. It should be noted that the edges of the channel member 140 and the insertion member 160 are rounded, both to protect the bag or tube being closed and to facilitate the interengagement of the two members.

While in the example shown in FIGS. 6 and 7, the hinge axis 220 is substantially parallel to the insertion member 160 and the channel member 140, the same closing effect would be attained within the scope of the present invention by arranging the hinge axis at an angle to each of these two members, provided that they meet in mutual engagement when the closure is closed.

In the exemplary embodiment shown in FIGS. 6 and 7, the closure 100 substantially consists of a comparatively rigid plastics material, such as for example polystyrene or unsoftened polyvinyl chloride, while only the hinge 270 is made from more flexible material, such as a thin sheet of polyester with a thickness permitting the requisite flexing, interconnecting the edges of the female and male parts 110 and 120, respectively, at a sufficiently small mutual distance to provide the effect of a hinge with a reasonably well-defined axis 220—sufficiently well-defined for the hinge 270 to guide the two members 160 and 140 into mutual engagement when the closure 100 is being closed. If the hinge 270 is made in the manner indicated, it may be cemented or welded to the two parts 110 and 120 in a suitable manner. It would also be possible, however, to form the hinge 270 as an integral part of a moulded article comprising also the female and male parts 110 and 120 respectively, in which case the material used would need to have the requisite properties with regard to flexibility and rigidity, i.e. flexible enough for the hinge effect to be attained, but rigid enough for the female and male parts 110 and 120 to cooperate in the manner indicated in closing a bag or tube (not shown) having been placed between the insertion member 160 and the channel member 140 before their final mutual engagement.

In the exemplary embodiment shown in FIGS. 6 and 7, each of the channel member 140 and the insertion member 160 is formed as a pair of walls or ribs protruding at substantially right angles from the female and male parts 110 and 120 respectively, the latter substantially consisting of flat pieces of material with—apart from the channel and insertion members just mentioned—only a hinge carrier 280 and 290, respectively, protruding to the same side as said members.

The channel member 140, the insertion member 160 and the hinge carriers 280 and 290 are so dimensioned that the axis height 210 above the upper flat side 250 and 260 of the female and male parts 110 and 120 is substantially one-half of the height 180 with which the channel member 14 and the insertion member 16, protrude in the same direction. This will, of course, result in the closure 100 closing in the manner shown in FIG. 7 with the latter height 180 being the spacing between the two parts 110 and 120. If the internal width 170 is substantially equal to the external width 200 and the walls constituting the channel member 140 and the insertion member 160 extend at right angles to the said upper flat sides of the female and male parts 110 and 120 respectively, and provided the radial distances 190 and 230 from the hinge axis 220 of the internal and external walls respectively of the channel member 140 and the insertion member 160 closest to the hinge axis 220 are also substantially equal, then there will be a certain "over-centre" action in the first stages of the bringing together of the channel member 140 and the insertion member 160, as will be obvious from a consideration of the geometry of the components involved this "over-centre" action may be likened to a snap action improving the mutual hold of the two members 140 and 160 in the closed state of the closure 100 as shown in FIG. 7.

The internal width 170 of the channel member 140 will, of course, have to be at least roughly equal to the external width 200 of the channel member 160, although the relative dimensioning chosen will depend on the nature of the material used for the closure and the expected thickness of the bag or tube to be closed.

As can be seen from FIGS. 6 and 7 both the channel member 140 and the insertion member 160 are placed at a small distance from the edges of the female and male parts 110 and 120, respectively, so as to form a gripping flange 240 facilitating the opening of the closure 100, when it is desired to open the bag or tube to be closed.

As can be seen from FIGS. 6 and 7, both the channel member 140 and the insertion member 160 are placed at a small distance from the edges of the female and male parts 110 and 120, respectively, so as to form a gripping flange 240 facilitating the opening of the closure 100, when it is desired to open the bag or tube in question and/or to recover the closure.

In the exemplary embodiment shown in FIGS. 6 and 7, the insertion member 120 consists of two substantially parallel walls protruding from the male part 120. This construction gives a desirable resilience, but if the resilience of the channel member 140 alone is considered sufficient, then the insertion member 160 may be solid or tubular, or have some other shape with reduced resilience.

In the exemplary embodiment shown in FIGS. 1 and 2, the internal surfaces of the channel member 140 and the cooperating internal surfaces of the insertion member 160 are substantially parallel, as a certain degree of snap action will be provided even with such a construction. If a higher degree of snap action is desired, then the two members may be profiled accordingly, such as will be illustrated in the following description of a second exemplary embodiment of a closure according to the present invention, shown in FIGS. 8 and 9.

Figure 9:
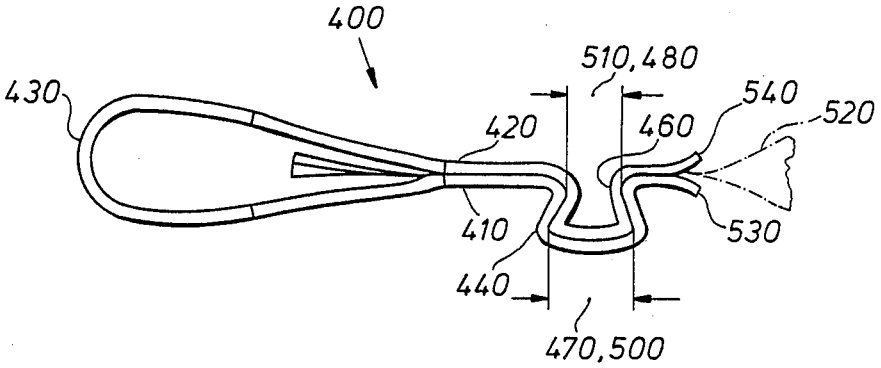

The closure 400 shown in FIGS. 8 and 9 consists in general of a female part 410, a male part 420 and a flexible interconnection bridge 430. The female part 410 comprises a channel member 440, the opening 450 of which faces towards FIG. 8. The male part 420 comprises an insertion member 460 facing in the same direction as the opening 450 of the channel member 440 when the closure 400 is un-flexed as shown in FIG. 8.

Although the insertion member 460 is channel-shaped in the exemplary embodiment shown, it need not necessarily be so shaped. It may, for example, be solid or tubular, provided that its external shape fulfils the requisite conditions for the correct functioning of the closure 400. Further, in the exemplary embodiment shown in FIGS. 8 and 9, the bridge 430 is flexible, although a hinged member may be used in its place, provided again that the requisite functional condition are fulfilled. These conditions will be evident from the following.

As will be evident from FIG. 8, the channel member 440 has a first internal width 470 some distance from the opening 450, and a somewhat smaller second internal width 480 closer to the opening 450. Correspondingly, close to its free end face 490, the insertion member 400 has a first external width 500 that is greater than the second internal width 450 of the channel member 440. A second external width 510 more distant from the free end face 490 is smaller than the first external width 500, and at least roughly equal to or somewhat smaller than the second internal width 480 of the channel member 440.

When the closure 400 is to be used, the bridge 430 is flexed in such a direction, i.e. with its middle part bending away from the viewer and downwards, respectively, in the two views shown in FIG. 8, that the female part 410 and the opening 450 in the channel member 440 facing the free end face 490 on the insertion member 460. In a position (not shown) in which there is still a distance between the two members 440 and 460, the open end of a thin-walled tube or bag 520—of which only the end portion is shown in FIG. 9—is inserted into the space between the two members 440 and 460, which are then brought together with the insertion member 460 pressed into the channel member 440 as shown in FIG. 4. The edges of the female and male members 410 and 420 may be rounded or flared as shown at 530 and 540, respectively, to avoid injury to the thin-walled tube or bag 520, which—especially when it is a bag for freezing ice in compartments in the bag, at present the preferred use of the closure according to the invention—may have extremely thin walls with a thickness of the order of 0.001 mm.

As will be evident from the drawings, it is a prerequisite for the proper functioning of the closure 400 that either the edges 550 at the entrance of the channel member 460 or the edges on both sides of the free end face 490 of the insertion member 460, or—preferably—both are rounded (as shown) or chamfered, so as to make it possible to press the insertion member 460 into engagement with the channel member 440 as shown in FIG. 9.

This is, of course, analogous to the conditions for the proper fuctioning of snap fasteners and the like. The rounded shape shown is preferred to avoid injury to the thin-walled tube or bag 520 when the two members 440 and 460 are being brought into mutual engagement.

Further, it will also be evident that it is a further prerequisite for the proper functioning of the closure 400 that either the channel member 440 be capable of being expanded elastically or the insertion member 460 be capable of being compressed elastically (both in directions at least roughly parallel to the widths mentioned above) or—preferably—both. To this end, the entire closure 400 may be formed from a suitable plastics material, such as polyethylene or polypropylene exhibiting the requisite elastic properties, with a thickness ensuring the requisite force to close the end of the thin-walled tube or bag 520 in a sufficiently fluid-tight manner. A person skilled in the art of making articles of plastics material will be able—by calculation or experiment or both—to find the right material and dimensions. It should be noted that a certain degree of "creep" may be allowed, when the closure is to be used for closing ice freezing bags of the kind referred to above, as the fluid pressure exerted by the water in the bag will disappear as soon as the water has been frozen to ice.

In the exemplary embodiment shown, the shape of the female part 410 is somewhat different from the shape of the male part 420, and the two parts are placed on each end of a flexible interconnecting bridge 430. It is, however, also possible within the scope of the invention in a manner not shown in the drawings to use two identically shaped channel-shaped members with such a shape, thickness and elastic properties that one may be pressed into engagement with the other with the end of the thin-walled tube or bat—such as the one shown at 520 in FIG. 9—in-between. These two identically shaped members could be unattached or attached to each other, such as in the manner shown in FIGS. 8 and 9, or by means of a hinged member, cords or chains.

To open the closure 400 from the closed condition shown in FIG. 9, the two parts 410 and 420 may be pulled apart by inserting a finger of each hand in the loop formed by the flexible bridge 430 and pulling in directions at right angles to the plane of the parts 410 and 420. Another possibility is to insert a table knife or the like between the two rounded edges 530 and 540. A third possibility would be to extend the side walls in the channel member 440 downwards in FIG. 9 to form levers or handles (not shown), which when pressed together would open the channel member 440.

I claim:

1. A flexible mould for freezing small bodies of ice, said mould having the shape of a bag with a filling duct for filling the bag with a liquid, said mould further comprising opposed walls, said walls having bonding areas of a first type, said bonding areas of the first type forming boundries of said filling duct and further defining elongated connecting areas between the walls of said bag and connecting lines along the edges of the bag, the elongated connecting areas being arranged along several lines and rows dividing the bag into a plurality of compartments with channels between adjacent compartments as fluid connections between adjacent compartments, said bonding areas of the first type comprising relatively weak bonding means allowing the opposite walls to be pulled apart without destroying or damaging the walls themselves, said bonding areas of the first type being loosenable from each other over their entire connecting area to change the bag with compartments into a bag without compartments.

2. A mould according to claim 1, wherein the bonding areas of the first type are formed by multiple spot welding, the welding spots having microscopic size.

3. A mould according to claim 1, wherein the bonding areas of the first type are formed by multiple line welding, the welding lines having microscopic size.

4. A mould according to claim 1, wherein said bonding areas of the first type have a bonding characteristic considerably reducing with decreasing temperature.

5. A flexible mould for freezing small bodies of ice, said mould having the shape of a bag with a filling duct for filling the bag with a liquid further comprising opposed walls, said walls having bonding areas of a first type, said bonding areas of the first type forming boundries of said filling duct and further defining elongated connecting areas between the walls of said bag and connecting lines along the edges of the bag, the elongated connecting areas being arranged along several lines and rows dividing the bag into a plurality of compartments with channels between adjacent compartments as fluid connections between adjacent compartments, said bonding areas of the first type comprising relatively weak bonding means allowing the opposite walls to be pulled apart without destroying or damaging the walls themselves, said bonding areas of the first type being loosenable from each other over their entire connecting area to change the bag with compartments into a bag without separate compartments, the bag further comprising bonding areas of a second type having considerably higher strength than the bonding areas of the first type, said bonding areas of the second type being arranged along the edges of the bag.

6. A flexible mould for freezing small bodies of ice, said mould having the shape of a bag with a filling duct for filling the bag with a liquid further comprising opposed walls, said walls having bonding areas of a first type, said bonding areas of the first type forming the boundries of said filling duct and further defining connecting areas between the walls of said bag and between the edges of the bag, leaving open elongated stacked compartments which are connected to each other and with the filling duct by a channel extending within the bag normal to said compartments, further comprising tear lines with reduced strength along said connecting areas between adjacent compartments, said tear lines allowing the mould to be disrupted along the tear lines substantially without any disruption of said bonding area.

7. A mould according to claim 6, wherein the compartments are elongated and substantially parallel to each other and wherein the filling duct is connected through said channel to the ends of the compartments facing in the same direction.

8. A mould according to claim 7, where the compartments further comprise an external recess opposite to each compartment for facilitating opening the respective compartment after having been removed from the remainder of the mould by disrupting the mould at the tearing lines.

* * * * *